US009162739B2

(12) United States Patent
Chew et al.

(10) Patent No.: US 9,162,739 B2
(45) Date of Patent: Oct. 20, 2015

(54) INFLATABLE PORTABLE PLATFORM

(75) Inventors: Hong Meng Alan Chew, Kuala Lumpur (MY); Joon Yip Chew, Kuala Lumpur (MY)

(73) Assignee: JOHNSON & NICHOLSON (M) SDN BHD, Kuala Lumpur (MY)

( * ) Notice: Subject to any disclaimer, the term of this patent is extended or adjusted under 35 U.S.C. 154(b) by 593 days.

(21) Appl. No.: 13/577,273

(22) PCT Filed: Jan. 28, 2011

(86) PCT No.: PCT/MY2011/000010

§ 371 (c)(1),
(2), (4) Date: Feb. 28, 2013

(87) PCT Pub. No.: WO2011/096792

PCT Pub. Date: Aug. 11, 2011

(65) Prior Publication Data

US 2013/0196560 A1 Aug. 1, 2013

(30) Foreign Application Priority Data

Feb. 8, 2010 (MY) ..... PI2010000570

(51) Int. Cl.

| | |
|---|---|
| ***B63B 35/58*** | (2006.01) |
| ***B63C 9/04*** | (2006.01) |
| ***A47C 27/08*** | (2006.01) |
| ***A47C 27/10*** | (2006.01) |
| ***A63K 3/00*** | (2006.01) |
| ***B63B 35/36*** | (2006.01) |
| ***E01F 13/02*** | (2006.01) |
| ***B60C 29/00*** | (2006.01) |

(52) U.S. Cl.

CPC ..... *B63C 9/04* (2013.01); *A47C 27/081* (2013.01); *A47C 27/087* (2013.01); *A63K 3/00* (2013.01); *B63B 35/36* (2013.01); *B63B 35/58* (2013.01); *B63C 9/24* (2013.01); *E01F 13/02* (2013.01); *B63C 2009/042* (2013.01); *Y10T 137/0396* (2015.04)

(58) Field of Classification Search

CPC ..... B63B 35/36; B63B 35/38; B63B 35/607; B63B 35/613; B63C 9/04; B63C 9/24; B63C 2009/0076; B63C 2009/0082; B63C 2009/042; B63C 2009/044; B63C 2009/046; B63C 2009/048; A47C 27/081; A47C 27/082; A47C 27/084; A47C 27/087; A47C 27/10; A63K 3/00; E01F 13/02

USPC ..... 114/345, 348–350; 441/40, 41, 129; 5/681, 706, 708, 710–714

See application file for complete search history.

(56) References Cited

U.S. PATENT DOCUMENTS 5,561,873 A * 10/1996 Weedling ..... 5/713
6,073,291 A * 6/2000 Davis ..... 5/711

*Primary Examiner* — Ajay Vasudeva
(74) *Attorney, Agent, or Firm* — Kilpatrick Townsend & Stockton LLP

(57) ABSTRACT

An inflatable buoyant platform (100) comprising a hollow inflatable enclosure (105) having a top surface (165) and a bottom surface (170), which are being peripherally joined by a flexible curtain (175). A support means (180) being provided inside the enclosure (105), the support means (180) adopts an extended form inside the enclosure (105) to enhance the rigidity of the enclosure (105) when the platform (100) is inflated, the support means (180) adapts a retracted form inside the enclosure (105) when the enclosure (105) is deflated. At least one inflating valve (135) on the enclosure (105) for inflating the enclosure (105) by an external source of compressed gas; at least one deflating valve (145) on the enclosure (105) for deflating the enclosure by the external source of compressed gas; and at least one exit valve (185) on the enclosure (105) for allowing the compressed gas to escape while deflating the enclosure (105).

10 Claims, 5 Drawing Sheets

INFLATABLE PORTABLE PLATFORM

CLAIM OF PRIORITY

This is a National Phase application and claims priority to the following:

Malaysian Patent Application No. PI2010000570 filed on 8 Feb. 2010;

PCT Application No. PCT/MY2011/000010 filed on 28 Jan. 2011.

FIELD OF THE INVENTION

The present invention relates to an inflatable, portable and buoyant platform, particularly for emergency use, such as during a plane crash or a sinking ship.

BACKGROUND

Buoyant platforms are widely known for various usages, such as for rescuing persons out of water. Inflatable and buoyant platforms for carrying persons in water are common. Patent GB2455047A discloses an inflatable platform having a series of interconnected inflatable booms, membrane and an inflation means for inflating the platform, as it hits the water. Upon inflation, the booms form a circular or hexagonal structure over which the membrane is stretched and the inflation means is disposed at the centre of the inflated platform. U.S. Pat. No. 4,516,767 discloses an inflated platform structure for aiding platform stability, during bouncing. For being lightweight, portable and storage space friendly, inflatable platforms are also useful on land, particularly for various kinds of emergency operations and otherwise.

For big sized platforms, suitable support structure inside the platforms is desirable, to offer better rigidity, particularly when the load over it is mobile. Portability of such platforms is equally important. It is also desirable to have the option of altering the shapes and sizes of the platforms on the spot, as required.

Besides using the platform for emergency purpose due to its capability to float, the inflatable portable platform of the invention is also adaptable to be a platform solely for elevation purposes, during numerous events. Usage of the inflatable portable platform would eliminate laborious setting up of an elevation stage. The platform of the present invention is also adaptable as protective barriers. Protective barriers such as when installed during cycling or roller blading races is replaceable by the inflatable platform that is more efficiently installed and used.

SUMMARY OF THE INVENTION

In a preferred embodiment of the present invention, an inflatable, portable and a buoyant platform, particularly for emergency use, is proposed, that addresses the needs emphasized in the foregoing section. The platform comprises a hollow inflatable enclosure having a top surface, and a bottom surface, the two surfaces being peripherally joined by a flexible curtain. A support means is provided inside the enclosure, that adopts an extended form inside the enclosure when the enclosure is inflated. The support means in the extended form enhances rigidity of the enclosure when inflated and loaded. The support means adopts a retracted form when the enclosure is deflated, such that the volume of the platform is reduced for the convenience of storage or portability. The enclosure can be inflated by an external source of compressed gas through an inflating valve and deflated through a deflating valve and an exit valve, the valves being provided on the enclosure.

In a preferred embodiment, the support means comprises multiple support walls, each wall being pivotally coupled at its top edge to the interior of the top surface, while having its bottom edge free. In the extended form, the wall can stand perpendicularly between the top and the bottom surfaces, thus dividing the enclosure into multiple compartments. The multiple walls may preferably be configured in parallel rows. In the retracted form, each wall pivotally rotates about its top edge for laying along and between the top and the bottom surfaces. The gaps between the rows are such that the successive walls can serially lay in the retracted form. The pivotal rotation is limited to between the retracted form and the extended form, such that any rotation beyond that is prevented in order to reduce slippage of the walls from their extended form, when the platform is loaded and particularly when the load is moving over the platform.

In yet another preferred embodiment, the pivotal rotation is limited to between the retracted form and the extended form by providing a pivoting point at a periphery of the top edge, such that at least a portion of a top edge area urges against the interior of the top surface, when in extended form, thereby preventing further rotation.

In yet another preferred embodiment, the platform comprises a stopper for every wall, the stopper being immovably fixed to the interior of the bottom surface, such that under the extended form, the bottom edges of the walls are urged against their respective stoppers and a pivotal rotation beyond that of the extended form is prevented. This provides greater stability to the walls in the extended form, when the platform is loaded and particularly when the load is moving over the platform.

In an embodiment, in addition to the inflating valve, at least one compartmental valve is accomodated in each compartment through either the top and/or the bottom surface such that the compressed gas can be forced through the inflating valve and distributed to each compartmental valve. With this arrangement, the inflation operation is executed more uniformly and effectively across the multiple compartments.

In an embodiment, the exit valve is positioned on the enclosure opposite the walls such that during the deflating operation, the bottom edges bend towards the exit valve. The direction of flow of the compressed gas during the deflating operation thereby assists the retracting of the walls.

In a preferred embodiment, the enclosure further comprises a deflating valve, that is located in a direction opposite to the exit valve, such that during the deflating operation, with the exit valve being open, optionally, compressed gas can be forced through the deflating valve to push the walls for retracting. This mechanism assists the deflating operation, a rate of exit of the compressed gas through the exit valve being maintained higher than a rate of entry of the compressed gas through the deflating valve.

In an embodiment, an adhering means is provided between each wall and its respective stopper, for better stability of the wall in the extended form. The adhering means may be magnetic, electromagnetic or mechanical couplers. The top edges of the walls are preferably not magnetic, such that lifting the walls from the retracted form to the extended form is less resistive.

In yet another embodiment, the platform is provided with a connector mechanism on the exterior of the enclosure for coupling a plurality of the platforms together. The connectors may be any kind, that is convenient and quick for use, such as plug and socket kind of combinations or zipper type. The platforms may be inflated and then coupled, or vice versa.

In another aspect of the invention, a method of deflating the enclosure is proposed, comprising the steps of opening the exit valve and forcing compressed gas through the deflating valve, such that the rate of exit of the compressed gas through the exit valve is maintained higher than the rate of entry of the compressed gas through the deflating valve. In the embodiment where electromagnetic adhering means are provided, the power source to the electromagnet is switched off while deflating.

The present invention consists of certain novel features and a combination of parts hereinafter fully described and illustrated in the accompanying drawings and particularly pointed out in the appended claims; it being understood that various changes in the details may be possible without departing from the scope of the invention or sacrificing any of the advantages of the present invention.

BRIEF DESCRIPTION OF THE DRAWINGS

In the following drawings, same reference numbers generally refer to the same parts throughout. The drawings are not necessarily to scale, instead emphasis is placed upon illustrating the principles of the invention. The various embodiments and advantages of the present invention will be more fully understood when considered with respect to the following, detailed description, appended claims and accompanying drawings wherein:

DETAILED DESCRIPTION

Figure 1A:
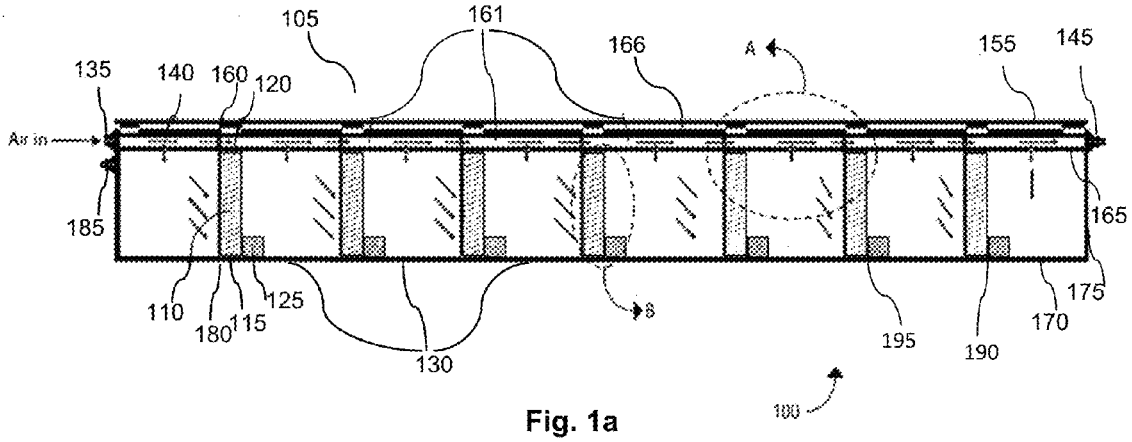
FIG. 1*a* illustrates a cross sectional view of the platform when in a fully inflated condition, according to an embodiment of the invention.
Figure 1B:
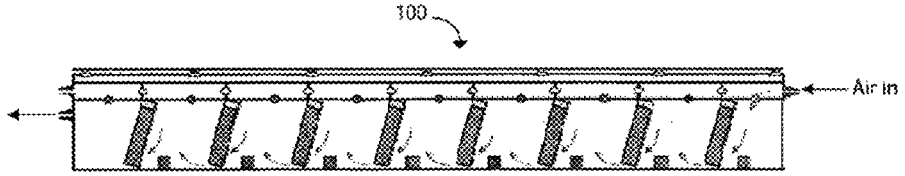
FIG. 1*b* to if illustrates a step by step view of FIG. 1*a*, during a deflating operation, according to an embodiment of this invention.
Figure 1C:
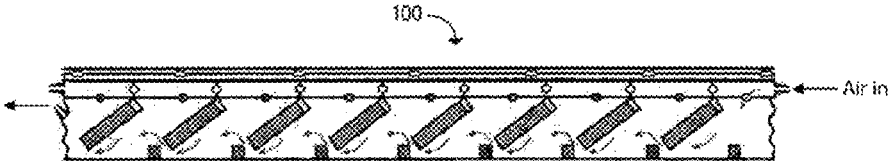
Figure 1D:
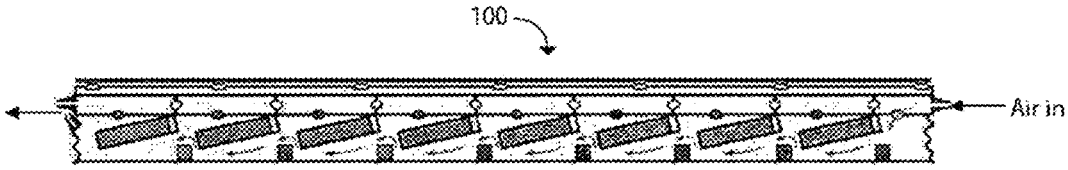
Figure 1E:
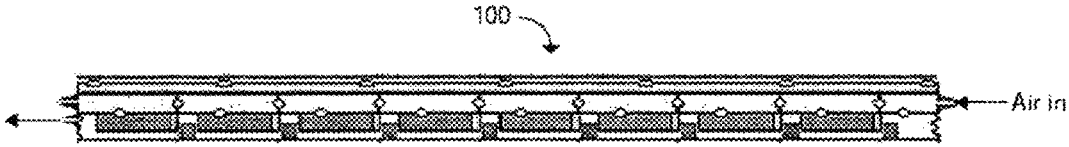
Figure 1F:
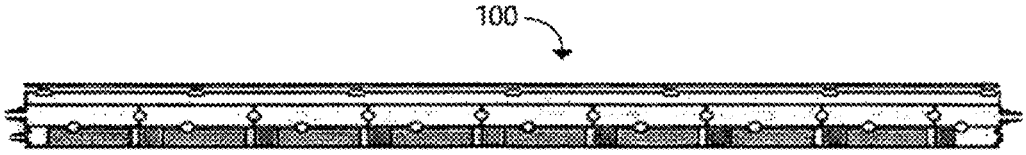

The following description presents several preferred embodiments of the present invention in sufficient detail such that those skilled in the art can make and use the invention.

Before describing in detail embodiments that are in accordance with the present invention, it should be noted that all of the figures are drawn for ease of explanation of the basic teachings of the present invention only. The extension of the figures with respect to the number, position, relationship and dimension of the parts of the preferred embodiment will be within the skill of the art after the following teachings of the present invention have been read and understood. Further, the exact dimensions and dimensional proportions to conform to specific force, weight, strength and similar requirements will likewise be within the skill of the art after the following teachings of the present invention have been read and understood.

FIGS. 1*a*-1*f* illustrate step by step cross-sectional views of an embodiment of the present invention for the inflatable and portable platform (100), from a fully inflated condition to a fully deflated condition. The platform includes a hollow inflatable enclosure (105) having a top surface (165) and a bottom surface (170), the top and the bottom surfaces (165, 170) being peripherally joined by a flexible curtain (175). A support means (180) is provided inside the enclosure (105), that adopts an extended form by itself, when the enclosure (105) is inflated. This enhances rigidity of the enclosure (105) when inflated and loaded, particularly when the load is mobile, like a person walking over it. The support means (180) adopts a retracted form by itself, when the enclosure (105) is deflated, such as when not in use. The support means (180) is made up of any material that is light weight and can withstand the pressure of the loads to be carried.

Figure 2A:
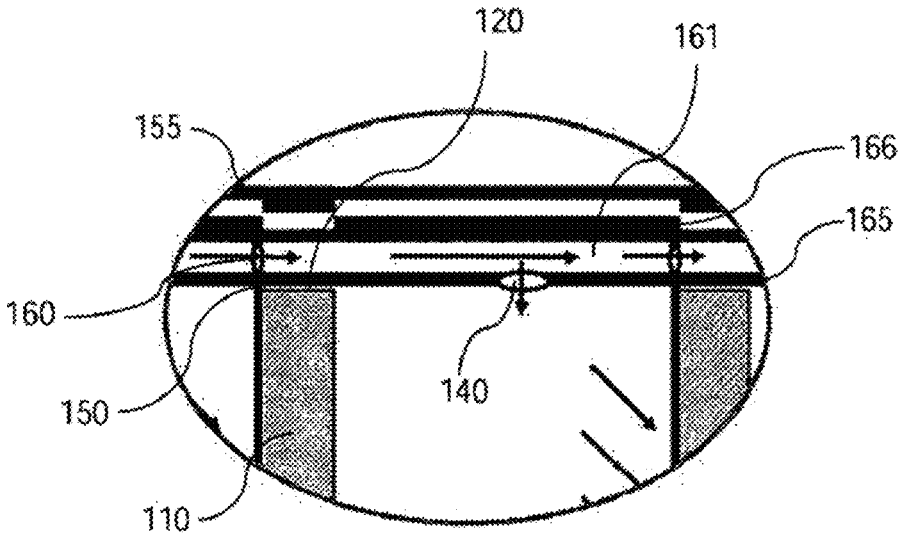
FIG. 2*a* is a blown up view of the section highlighted as A in FIG. 1*a*, illustrating the arrangement of the top edge of a wall relative to the top surface, in the extended form.

The enclosure (105) is inflatable by an external source of compressed gas through an inflating valve (135) and is deflatable through a deflating valve (145) and an exit valve (185), the valves (135, 145, 185) being provided on the enclosure (105). The valves are preferably flow control valves that regulate flow rate and pressure of the compressed gas. As shown in the figures, the support means (180) comprises multiple support walls (110), each wall (110) being pivotally coupled at its top edge (120) to the interior of the top surface (165) while having its bottom edge (115) free. When in the extended form, the wall (110) can stand perpendicularly between the top and the bottom surfaces (165,170). The walls (110) may preferably be configured in parallel rows, thus dividing the enclosure (105) into multiple compartments (130). In the retracted form, each wall (110) is configured to pivotally rotate about its top edge (120) for lying along and between the top and the bottom surfaces (165, 170). The gaps between the rows are such that the successive walls (110) can serially lie in the retracted form. The pivotal rotation is configured to be limited to between the retracted form and the extended form, such as by providing a hinge (150) at a periphery of the top edge (120). In such a case, at least a portion of a top edge area urges against the interior of the top surface (165), when in the extended form, and thus resisting further rotation. This feature is illustrated in FIG. 2*a*, which is a blown up view of the section highlighted as A in FIG. 1*a*, and shows the arrangement of the top edge (120) of a wall relative to the top surface (165), in the extended form.

Figure 2B:
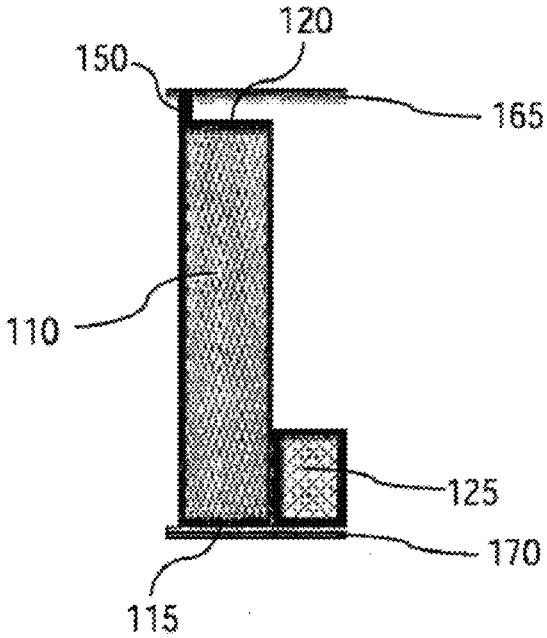
FIG. 2*b* is a blown up view of the section highlighted as B in FIG. 1*a*, illustrating the arrangement of a wall in the extended form being supported by a stopper.

The platform further comprises a stopper (125) for every wall (110), the stopper (125) being immovably fixed to the interior of the bottom surface (170), such that under the inflated condition, the bottom edges (115) of the walls (110) are urged against their respective stoppers (125). Such an arrangement provides greater stability to the walls (110) in the extended form, particularly when loaded. FIG. 2*b* is a blown up view of the section highlighted as B in FIG. 1*a*, showing the arrangement of a wall (110) in the extended form being supported by a stopper (125).

In addition to the inflating valve (135), at least one compartmental valve (140) is accomodated in each compartment (130) through either the top or the bottom surfaces (165, 170). In FIG. 1*a*-1*f*, there is also shown at least one unidirectional valve (160) between two consecutive airway (161). Both the compartmental valve (140) and the unidirectional valve (160) permits the compressed gas to flow in only one direction. The compartmental valve (140) allows compressed gas to flow from the voids (161) to the individual compartments (130) while the unidirectional valve (160) only permits compressed gas to flow from the inflating valve (135) to the deflating valve (145).

The arrangement of the valves (135, 140, 160, 145, 185) is such that the compressed gas can be forced through the inflating valve (135) and distributed to each compartments (130) during the inflating operation. During the operation, compressed gas is trapped within the compartments (130) as the deflating valve (145) prevents the compressed gas from escaping and the exit valve (185) is closed tight.

Figure 3:
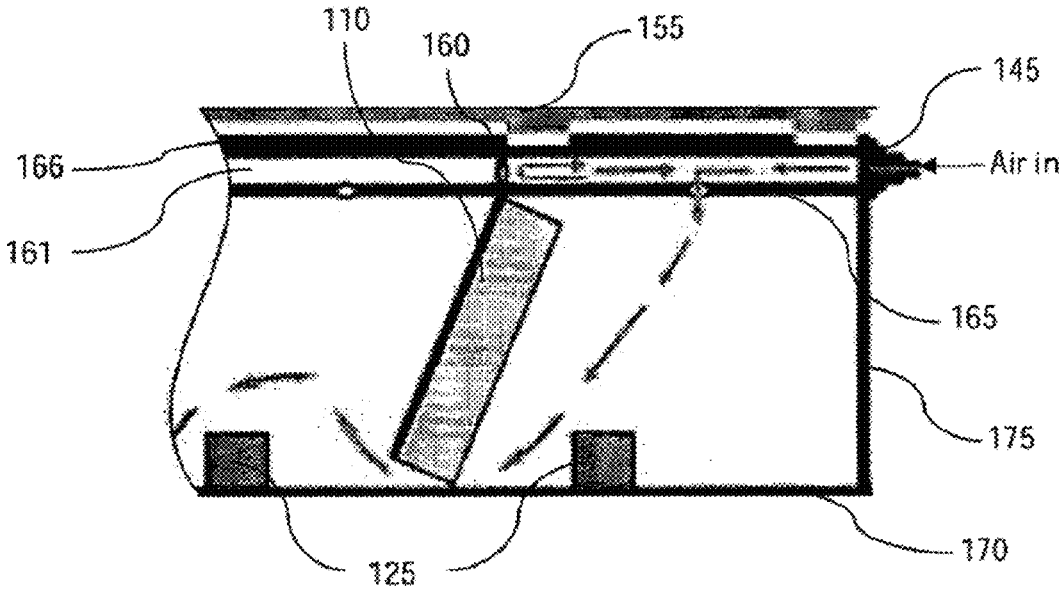
FIG. 3 illustrates the directional flow of the compressed gas as it is forced through a deflating valve.

The exit valve (185) is preferably positioned opposite to the walls (110) such that during the deflating operation the bottom edges (115) bend towards the exit valve (185). In FIG. 3, it is shown that the unidirectional valve (160) prevents the compressed gas from flowing in the direction of the deflating valve (145) to the inflating valve (135). The direction of flow of the compressed gas between compartments (130) during the deflating operation as opposed to the inflating operation assists the retraction of the walls (110).

Preferably, the deflating valve (145) is located in a direction opposite to the exit valve (185), such that during the deflating operation, with the exit valve (185) being open, compressed gas can be forced through the deflating valve (145) to push the walls (110) for retracting from its stoppers (125). The presence of the unidirectional valve (160) prevents the compressed air from flowing across the airway (161). Such an arrangement further assists the deflating operation, when a rate of exit of the compressed gas through the exit valve (185) is maintained higher than a rate of entry of the compressed gas through the deflating valve (145).

Preferably an adhering means (not shown) is provided between each wall (110) and its respective stopper (125) for better stability of the wall (110) in the extended form. The adhering means may be any type such as magnetic or mechanical coupling. For the magnetic type adhering means, the top edge (120) of the wall (110) is preferably not magnetic, such that lifting the wall (110) from the retracted form to the extended form is easier. The magnetic type may have the bottom of the walls (110) magnetic while the respective stoppers being electromagnetic or vice versa. Portable power sources (not shown) may be used for the electromagnetic type adhering means. While the deflating operation, the electromagnets can be switched off such that the walls (110) can bend away from the respective stoppers (125), assisted by the compressed gas forced in from the deflating valve (145).

Figure 4:
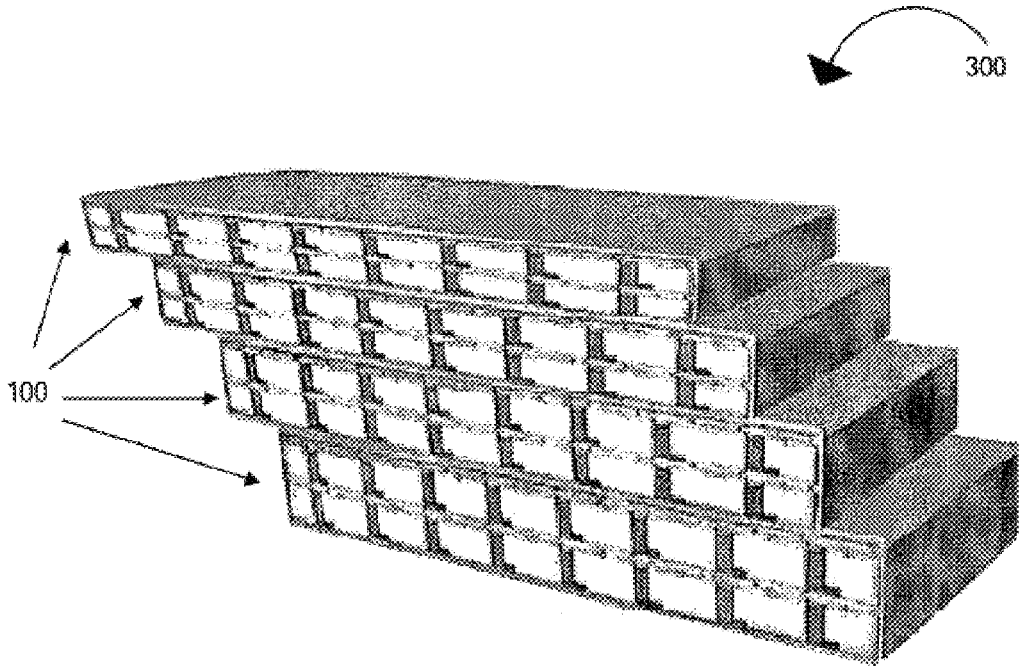
FIG. 4 is a perspective view demonstrating an arrangement of several platforms coupled together, for achieving a compound platform of a desired shape and size.

As shown with the partial view of a second platform (100) coupled over the first platform (100) as in FIG. 2*a*, the exterior of the bottom surface (170) of the second platform (100) and the exterior of the top surface (165) of the first platform (100) are provided with connection means (155) for coupling them together. Similarly, multiple platforms (100) can be coupled together, to form a compound platform (300) of different shape and size, as shown in FIG. 4.

Figure 5:
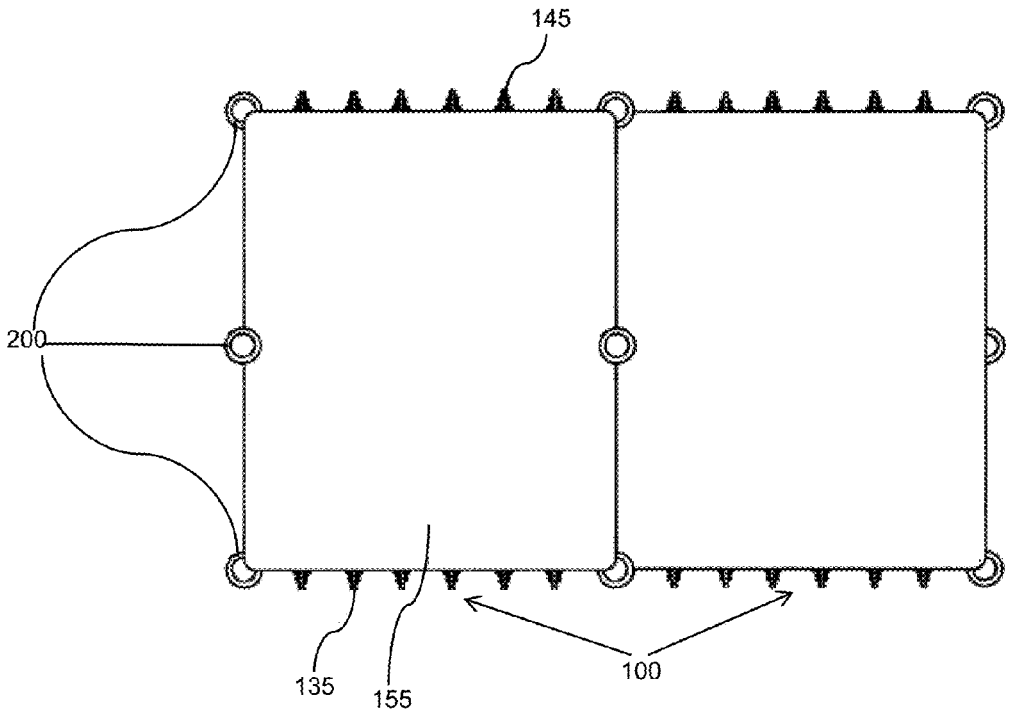
FIG. 5 illustrates a top view of a modularised version of the platform, connectable by tabs with hole.

In a preferred embodiment, the platforms (100) are modularised, whereby platforms (100) are connected to each other, by the connection means (155), forming different sized platforms as desired. The connection means (155) may be any type, such as plug and socket kind of combinations or zipping means. The platforms (100) are also connectable, from side to side. In this preferred embodiment the connection means (155) is a plurality of tabs (200) with holes, constructed at the perimeter of the platforms (100), particularly at the corners and at the middle of each sides as shown in FIG. 5. The plurality of tabs (200) may be fixed to each other with an insertion, preferably a pin bolt if the need for a bigger sized platform (100) arises. The modularity of the platform (100) would enhance the flexibility of the platform (100) to be used on a needs basis.

As to further discussion of the manner of usage and operation of the present invention, the same should be apparent from the above description. Accordingly, no further discussion relating to the manner of usage and operation will be provided.

While the foregoing description presents preferred embodiments of the present invention along with many details set forth for purpose of illustration, it will be understood by those skilled in the art that many variations or modifications in details of design, construction and operation may be made without departing from the present invention as defined in the claims. The scope of the invention is as indicated by the appended claims and all changes that come within the meaning and range of equivalency of the claims are intended to be embraced therein.

What is claimed is:

1. An inflatable buoyant platform (100) comprising:

a hollow inflatable enclosure (105) having a top surface (165) and a bottom surface (170), the top and the bottom surfaces (165,170) being peripherally joined by a flexible curtain (175);

a support means (180) being provided inside the enclosure (105), whereby the support means (180) adopts an extended form inside the enclosure (105) to enhance the rigidity of the enclosure (105) when the platform (100) is inflated, while the support means (180) adopts a retracted form inside the enclosure (105) when the enclosure (105) is deflated;

at least one inflating valve (135) on the enclosure (105) for inflating the enclosure (105) by an external source of compressed gas;

at least one deflating valve (145) on the enclosure (105) for deflating the enclosure by the external source of compressed gas; and at least one exit valve (185) on the enclosure (105) for allowing the compressed gas to escape while deflating the enclosure (105).

2. The platform (100) according to claim 1, wherein the support means (180) comprises a plurality of support walls (110), pivotally coupled at its top edge (120) to the interior of the top surface (165) while having its bottom edge (115) free, such that in the extended form, the walls (110) stand perpendicularly to the bottom surface (170) wherein the plurality of support walls (110) divide the enclosure (105) into a plurality of compartments (130), and in the retracted form, the plurality of walls (110) are rotatable about its top edge (120) to lay serially against the bottom surface (170).

3. The platform (100) according to claim 2, wherein the rotation of the walls is limited by providing a hinge (150) at a periphery of the top edge (120), such that in the extended form, at least a portion of the top edge (120) urges against the interior of the top surface (165), thereby resisting further rotation.

4. The platform (100) according to claim 2 wherein at least one of the plurality of support walls (110) is provided with a stopper (125), the stopper (125) is immovably fixed to the interior of the bottom surface (170), such that in the extended form, the bottom edge (115) of the at least one support wall (110) is urged against the stopper (125) to provide greater stability to the at least one support wall (110).

5. The platform (100) according to claim 2 or claim 4, wherein an electromagnetic adhering means (190) is provided between the stopper (125) and at least one of the plurality of support walls (110) operable by a portable power source wherein at least a portion of at least one of the plurality of support walls (110) is magnetic with at least a portion of the stopper (125) being an electromagnet or vice versa.

6. The platform (100) according to claim 2 or claim 4, wherein a mechanical coupling adhering means (195) is provided between the stopper (125) and the wall (110).

7. The platform (100) according to claim 1 further comprising:

a connecting means (155) along the exterior of the enclosure (105) for coupling a plurality of the platforms (100) together for forming a compound platform (300) of a different shape and size.

8. The platform (100) according to claim 1 further comprising:

at least one compartmental valve (140), accommodated to each plurality of compartments (130) to distribute the compressed gas through either the top or the bottom surfaces (165, 170), as it is received from the external source through the at least one inflating valve (135).

9. A method of inflating the platform (100) according to claim 1, comprising the steps of:

closing the at least one exit valve (185) to prevent compressed gas from escaping from the enclosure (105);

continuously forcing the compressed gas through the at least one inflating valve (135) until the compartments are completely expanded, a plurality of walls (110) stand perpendicularly to the top and bottom surfaces (165, 170), abutting a stopper (125); and switching electromagnetic adhering means (190) on to adhere the plurality of walls (110) to its respective stoppers (125) for better stability of the wall in the extended form.

10. A method of deflating the platform (100) according to claim 1, comprising the steps of:

switching electromagnetic adhering means (190) off from the power source to stop adherence of at least one of plurality of walls (110) to a stopper (125);

opening the at least one exit valve (185) allowing compressed gas to escape from the enclosure (105);

continuously forcing the compressed gas through the at least one deflating valve (145) until the compartments are completely deflated, the plurality of walls (110) retracted and bent towards the at least one exit valve (185), away from the stopper (125); and maintaining the rate of exit of the compressed gas through the at least one exit valve (185) to be higher than the rate of entry of the compressed gas through the at least one deflating valve (145).

* * * * *